US011538619B2

(12) United States Patent
Sato et al.

(10) Patent No.: US 11,538,619 B2
(45) Date of Patent: Dec. 27, 2022

(54) COIL COMPONENT

(71) Applicant: Murata Manufacturing Co., Ltd., Kyoto-fu (JP)

(72) Inventors: Mitsuhiro Sato, Nagaokakyo (JP); Ryohei Kawabata, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 483 days.

(21) Appl. No.: 16/829,756

(22) Filed: Mar. 25, 2020

(65) Prior Publication Data

US 2020/0312525 A1 Oct. 1, 2020

(30) Foreign Application Priority Data

Mar. 26, 2019 (JP) ..... JP2019-059021

(51) Int. Cl.
*H01F 27/28* (2006.01)
*H01F 27/29* (2006.01)

(52) U.S. Cl.
CPC ..... *H01F 27/2804* (2013.01); *H01F 27/29* (2013.01); *H01F 2027/2809* (2013.01)

(58) Field of Classification Search
CPC ..... H01F 27/2804; H01F 27/29; H01F 2027/2809
USPC ..... 336/192
See application file for complete search history.

(56) References Cited

U.S. PATENT DOCUMENTS 10,892,800 B1 * 1/2021 Katz ..... H04B 5/0037
11,075,030 B2 * 7/2021 Yoon et al. ..... H01F 27/2823
2008/0179445 A1 * 7/2008 Shoji et al. ..... 242/570
2009/0278652 A1 * 11/2009 Shoji et al. ..... H01F 17/04 336/221
2018/0130596 A1 * 5/2018 Yamaguchi ..... H01F 27/2804
(Continued)

FOREIGN PATENT DOCUMENTS

EP 1727164 A2 * 11/2006 ..... H01F 17/045
JP 2015-130472 A 7/2015
(Continued)

OTHER PUBLICATIONS

Office Action; "Notice of Reasons for Refusal," mailed by the Japanese Patent Office dated Oct. 19, 2021, which corresponds to Japanese Patent Application No. 2019-059021 and is related to U.S. Appl. No. 16/829,756 with English translation.

*Primary Examiner* — Suresh Memula
(74) *Attorney, Agent, or Firm* — Studebaker & Brackett PC

(57) ABSTRACT

A coil component including an element assembly that includes a support substrate having a cavity, a first coil disposed on a first principal surface of the support substrate, a second coil disposed on a second principal surface of the support substrate, and a magnetic portion. The coil component further includes first and second outer electrodes electrode electrically coupled to the first coil, and third and further outer electrodes electrically coupled to the second coil. Each outer electrode is disposed on the surface of the element assembly. The cavity of the support substrate, the core portion of the first coil, and the core portion of the second coil overlap at least one another when viewed in the direction perpendicular to the principal surface. The magnetic portion is disposed in at least the cavity and the two core portions. Also, the support substrate is formed of sintered ferrite.

16 Claims, 12 Drawing Sheets

(56) References Cited

U.S. PATENT DOCUMENTS

| | | | | |
|---|---|---|---|---|
| 2018/0254139 | A1 | 9/2018 | Yazaki | |
| 2019/0019616 | A1* | 1/2019 | Cha et al. | H01F 27/28 |

FOREIGN PATENT DOCUMENTS

| | | | |
|---|---|---|---|
| JP | 2018-137421 | A | 8/2018 |
| JP | 2018-170315 | A | 11/2018 |
| WO | 2017/110952 | A1 | 6/2017 |

* cited by examiner

COIL COMPONENT

CROSS-REFERENCE TO RELATED APPLICATION

This application claims benefit of priority to Japanese Patent Application No. 2019-059021, filed Mar. 26, 2019, the entire content of which is incorporated herein by reference.

BACKGROUND

Technical Field

The present disclosure relates to a coil component.

Background Art

To date, coil arrays have been used for inductors. For example, Japanese Unexamined Patent Application Publication No. 2018-137421 discloses a coil array including a coil on each of the upper surface and the lower surface of a substrate.

In the coil array described in Japanese Unexamined Patent Application Publication No. 2018-137421, a material having no magnetic characteristics, for example, a printed circuit board, is used as the substrate, the degree of flexibility in adjustment of the coupling coefficient between a first coil and a second coil is low, and the coupling may be insufficient.

SUMMARY

Accordingly, the present disclosure provides a coil component having a high degree of flexibility in adjustment of the coupling coefficient between a first coil and a second coil.

The present disclosure includes the following aspects.

(1) A coil component including an element assembly that includes a support substrate having a cavity, a first coil disposed on a first principal surface of the support substrate, a second coil disposed on a second principal surface of the support substrate, and a magnetic portion. The coil component further includes a first outer electrode and a second outer electrode electrically coupled to the first coil, and a third outer electrode and a fourth outer electrode electrically coupled to the second coil, with each outer electrode being disposed on the surface of the element assembly. The cavity of the support substrate, the core portion of the first coil, and the core portion of the second coil overlap at least one another in plan view when viewed in the direction perpendicular to the principal surface of the support substrate. The magnetic portion is disposed in at least the cavity of the support substrate, the core portion of the first coil, and the core portion of the second coil. Also, the support substrate is formed of sintered ferrite.

(2) The coil component according to (1) above, wherein the thickness of the support substrate is about 40 μm or more and 80 μm or less (i.e., from about 40 μm to 80 μm).

(3) The coil component according to (1) or (2) above, wherein the magnetic permeability μ1 of the magnetic portion is about 20 or more and 40 or less (i.e., from about 20 to 40).

(4) The coil component according to any one of (1) to (3) above, wherein the ratio of the magnetic permeability μ2 of the support substrate to the magnetic permeability μ1 of the magnetic portion is about 0.7 or less.

(5) The coil component according to any one of (1) to (4) above, wherein (x, y) are present in a region surrounded by A-B-C-D-E-F-G-H-I-J-A described below A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents the thickness of the support substrate and y represents the ratio of the magnetic permeability μ2 of the support substrate to the magnetic permeability μ1 of the magnetic portion.

The coil component according to the present disclosure has a high degree of flexibility in adjustment of the coupling coefficient between the first coil and the second coil because the substrate formed of sintered ferrite is used as the substrate between the first coil and the second coil.

Other features, elements, characteristics and advantages of the present disclosure will become more apparent from the following detailed description of preferred embodiments of the present disclosure with reference to the attached drawings.

DETAILED DESCRIPTION

A coil component 1 according to an embodiment of the present disclosure will be described below in detail with reference to the drawings. However, the shapes, arrangements, and the like of the coil component and constituent elements of the present embodiment are not limited to the examples illustrated.

Figure 1:
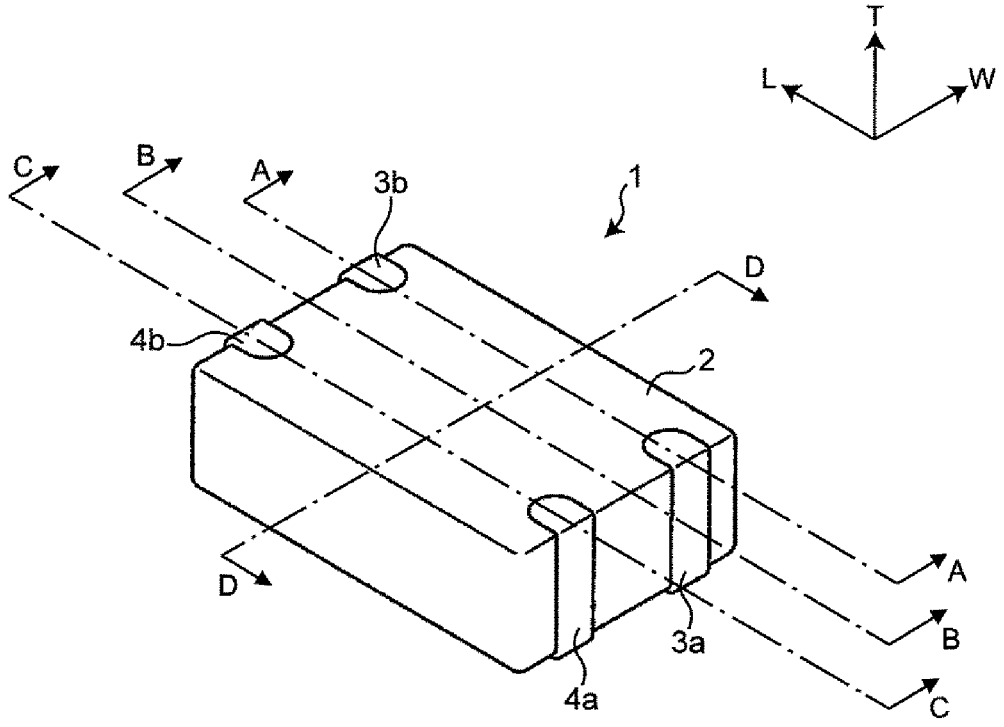
FIG. 1 is a perspective view of a coil component according to an aspect of the present disclosure.
Figure 2:
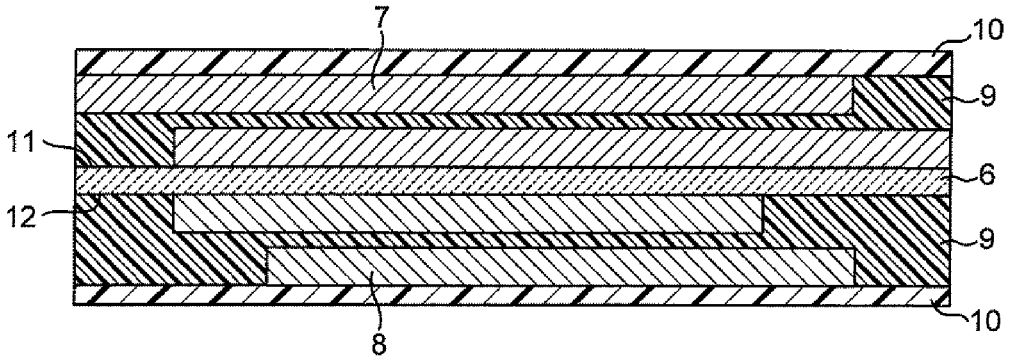
FIG. 2 is a sectional view of the section indicated by line A-A of the coil component.
Figure 3:
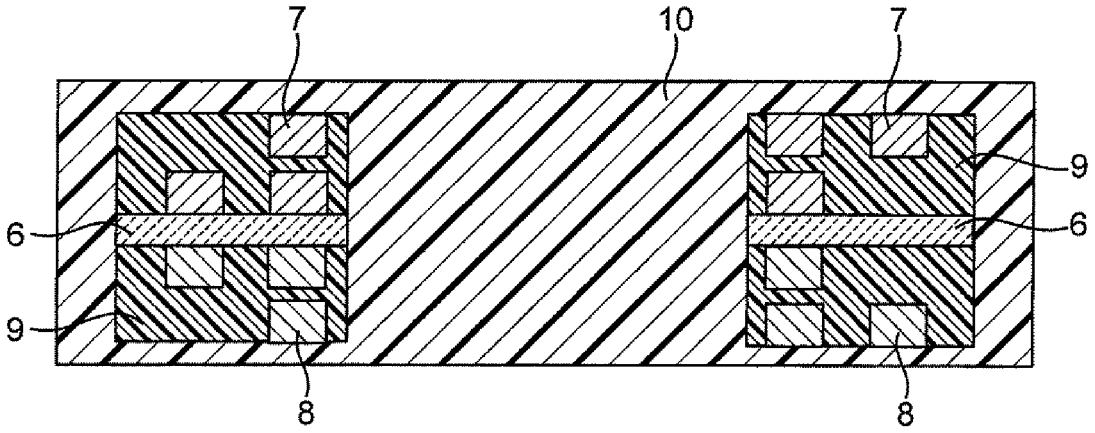
FIG. 3 is a sectional view of the section indicated by line B-B of the coil component.
Figure 4:
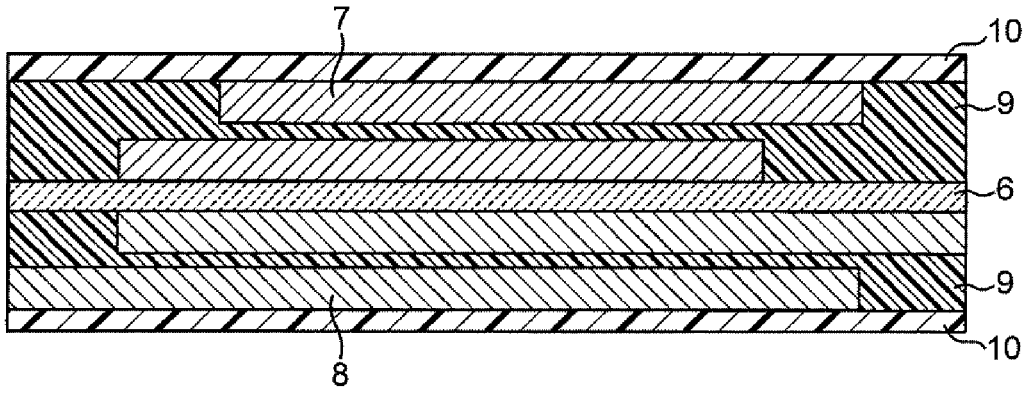
FIG. 4 is a sectional view of the section indicated by line C-C of the coil component.
Figure 5:
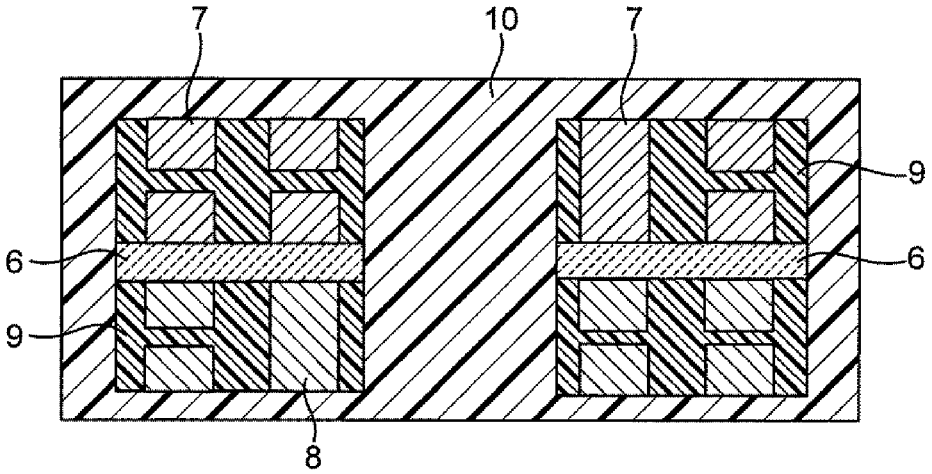
FIG. 5 is a sectional view of the section indicated by line D-D of the coil component.

FIG. 1 is a perspective view of the coil component 1 according to the present embodiment, FIG. 2 is a sectional view of the section indicated by line A-A, FIG. 3 is a sectional view of the section indicated by line B-B, FIG. 4 is a sectional view of the section indicated by line C-C, and FIG. 5 is a sectional view of the section indicated by line D-D. As shown in FIGS. 1 to 5, the coil component 1 according to the present embodiment is a coil component having a substantially rectangular parallelepiped shape. In the coil component 1, the surfaces perpendicular to the L-axis in FIG. 1 are denoted as "end surfaces", the surfaces perpendicular to the W-axis are denoted as "side surfaces", and the surface perpendicular to the T-axis is denoted as "upper or lower surface". The coil component 1 includes an element assembly 2, a first outer electrode 3*a*, a second outer electrode 3*b*, a third outer electrode 4*a*, and a fourth outer electrode 4*b*, that are disposed on the respective end surfaces of the element assembly 2. The element assembly 2 includes a support substrate 6, a first coil 7 disposed on a first principal surface 11 of the support substrate 6, a second coil 8 disposed on a second principal surface 12 of the support substrate 6, an insulating portion 9 disposed around the first coil 7 and the second coil 8, and a magnetic portion 10 disposed so as to surround these. That is, the first coil 7 and the second coil 8 are embedded in the magnetic portion 10. One end of the first coil 7 is electrically coupled to the first outer electrode 3*a*, and the other end is electrically coupled to the second outer electrode 3*b*. One end of the second coil 8 is electrically coupled to the third outer electrode 4*a*, and the other end is electrically connected to the fourth outer electrode 4*b*. The first coil 7 and the second coil 8 are α-winding coils and are opposite each other with the support substrate 6 interposed therebetween. The axis of the first coil 7 and the axis of the second coil 8 lie on a straight line perpendicular to the principal surface of the support substrate 6. That is, the first coil 7 and the second coil 8 are arranged such that the winding portion of the first coil 7 is superposed on the winding portion of the second coil 8 in plan view when viewed in the coil axis direction. In this regard, the winding portion of the coil denotes a portion in which a coil conductor is wound. The support substrate 6 supports the first coil 7 and the second coil 8 and is present in a region in which at least the first coil 7 and the second coil 8 are present in plan view when viewed in the coil axis direction. The support substrate 6 has a cavity arranged so as to be superposed on the core portions of the first coil and the second coil in plan view when viewed in the coil axis direction. In this regard, the core portion of the coil denotes a region inside the winding portion of the coil.

The support substrate 6 is formed of sintered ferrite which improves the degree of flexibility in adjustment of the coupling coefficient between the first coil and the second coil.

The support substrate 6 is arranged so as to be superposed on a first coil conductor and a second coil conductor in plan view. The support substrate 6 has a cavity 5, and the cavity is arranged so as to be superposed on the core portion of the first coil and the core portion of the second coil. In the coil component according to the present disclosure, in plan view, the shape of the support substrate has to be a shape that overlaps at least the coil conductor of the first coil and the coil conductor of the second coil and that has a cavity overlapping at least the core portion of the first coil and the core portion of the second coil. The support substrate having the above-described shape improves the degree of flexibility in adjustment of the coupling coefficient between the first coil and the second coil.

The thickness of the support substrate 6 is preferably about 40 μm or more and 80 μm or less (i.e., from about 40 μm to 80 μm) and more preferably about 50 μm or more and 70 μm or less (i.e., from about 50 μm to 70 μm). Setting the thickness of the support substrate 6 to be within the above-described range improves the degree of flexibility in adjustment of the coupling coefficient between the first coil and the second coil and facilitates, for example, adjusting the coupling coefficient to be within the range of about −0.7 or more and −0.5 or less (i.e., from about −0.7 to −0.5).

Regarding the magnetic permeability μ2 of the support substrate 6, the ratio μ2/μ1 (μ1 is the magnetic permeability of the magnetic portion) is preferably about 0.05 or more and 0.54 or less (i.e., from about 0.05 to 0.54) and more preferably 0.15 or more and 0.20 or less (i.e., from 0.15 to 0.20).

The sintered ferrite contains Fe, Zn, and Ni as primary components and, as the situation demands, further contains Cu. Usually, the primary components of the sintered ferrite are substantially composed of oxides of Fe, Zn, Ni, and Cu. Preferably, the sintered ferrite is Ni—Cu—Zn-based ferrite.

Regarding the sintered ferrite, the Fe content is preferably about 40.0% by mole or more and 49.5% by mole or less (i.e., from about 40.0% by mole to 49.5% by mole) in terms of $Fe_2O_3$ (with reference to the total primary components, the same applies thereafter) and more preferably about 45.0% by mole or more and 49.5% by mole or less (i.e., from about 45.0% by mole to 49.5% by mole).

Regarding the sintered ferrite, the Zn content is preferably about 2.0% by mole or more and 35.0% by mole or less (i.e., from about 2.0% by mole to 35.0% by mole) in terms of ZnO (with reference to the total primary components, the same applies thereafter) and more preferably about 5.0% by mole or more and 30.0% by mole or less (i.e., from about 5.0% by mole to 30.0% by mole).

Regarding the sintered ferrite, the Cu content is preferably about 6.0% by mole or more and 13.0% by mole or less (i.e., from about 6.0% by mole to 13.0% by mole) in terms of CuO (with reference to the total primary components, the same applies thereafter) and more preferably about 8.0% by mole or more and 10.0% by mole or less (i.e., from about 8.0% by mole to 10.0% by mole).

Regarding the sintered ferrite, there is no particular limitation regarding the Ni content, and the Ni content is the remainder of the primary components, that is other than Fe, Zn, and Cu, and is preferably about 10.0% by mole or more and 45.0% by mole or less (i.e., from about 10.0% by mole to 45.0% by mole) in terms of NiO (with reference to the total primary components, the same applies thereafter).

In the present disclosure, the sintered ferrite may further contain additive components. Examples of the additive components in the sintered ferrite include Mn, Co, Sn, Bi, and Si, but the additive components are not limited to these. The content (amount of addition) of each of Mn, Co, Sn, Bi, and Si is preferably about 0.1 parts by weight or more and 1 part by weight or less (i.e., from about 0.1 parts by weight to 1 part by weight) in terms of $Mn_3O_4$, $Co_3O_4$, $SnO_2$, $Bi_2O_3$, and $SiO_2$, respectively, relative to 100 parts by weight of the total primary components (Fe (in terms of $Fe_2O_3$), Zn (in terms of ZnO), Cu (in terms of CuO), and Ni (in terms of NiO)). The sintered ferrite may further contain incidental impurities during production.

The support substrate 6 may be produced as described below, for example. $Fe_2O_3$, ZnO, CuO, and NiO and, as the situation demands, additive components are weighed as a ferrite material so as to have a predetermined composition, mixed, and pulverized. The pulverized ferrite material is dried and calcined at, for example, about 600° C. or higher and 800° C. or lower (i.e., from about 600° C. to 800° C.) so as to obtain a calcined powder. The resulting calcined powder is mixed with predetermined amounts of organic binder such as polyvinyl butyral, organic solvent such as ethanol or toluene, and plasticizer and is subjected to pulverization and sheet forming. A plurality of resulting sheets are stacked to have a predetermined thickness and are subjected to thermocompression bonding. Cutting into a predetermined size is performed and a cavity is formed. Firing is performed at a temperature of, for example, about 1,000° C. or higher and 1,200° C. or lower (i.e., from about 1,000° C. or higher to 1,200° C.) so as to obtain a support substrate composed of the sintered ferrite.

The first coil 7 and the second coil 8 are disposed on the first principal surface 11 and the second principal surface 12, respectively, of the support substrate 6. That is, the first coil 7 and the second coil 8 are arranged to be opposite each other with the support substrate 6 interposed therebetween.

Each of the first coil 7 and the second coil 8 is formed by electrically coupling coil conductors to each other. Each coil conductor contains a conductive material. Preferably, each coil conductor is substantially composed of a conductive material. There is no particular limitation regarding the conductive material, and examples of the conductive material include Au, Ag, Cu, Pd, and Ni. The conductive material is preferably Ag or Cu and more preferably Cu. The conductive material may be at least one type.

As described above, in the present embodiment, each of the first coil 7 and the second coil 8 is formed by electrically coupling coil conductors to each other but is not limited to this. A coil formed separately may be arranged on the support substrate. In the present embodiment, each of the first coil 7 and the second coil 8 is an α-winding coil but is not limited to this. Further, the winding directions of the coils may be the same or different from each other.

The insulating portion 9 is disposed between the coil conductor of the first coil 7 and the coil conductor of the second coil 8. Disposition of the insulating portion 9 enables insulation between the coil conductors to be more reliable.

Preferably, the insulating portion 9 is formed of an insulating resin. Preferable examples of the insulating resin include thermosetting polyimide resins and epoxy resins.

The magnetic portion 10 is formed of a composite material containing a magnetic powder and a resin material.

There is no particular limitation regarding the resin material, and examples of the resin material include thermosetting resins such as epoxy resins, phenol resins, polyester resins, polyimide resins, and polyolefin resins. The resin material may be at least one type.

The magnetic powder is preferably metal particles or ferrite particles and more preferably metal particles. The magnetic powder may be at least one type.

There is no particular limitation regarding the metal material constituting the metal particles, and examples of the metal material include iron, cobalt, nickel, and gadolinium or alloys containing at least one of these.

The metal material is preferably iron or an iron alloy. Iron may be iron only or an iron derivative, for example, a complex. There is no particular limitation regarding the iron derivative, and examples of the iron derivative include iron carbonyl, which is a complex of iron and CO, and preferably iron pentacarbonyl. In particular, a hard-grade iron carbonyl (for example, a hard-grade iron carbonyl produced by BASF) having an onion skin structure (structure in which concentric-sphere-shaped layers are formed around the center of a particle) is preferable. There is no particular limitation regarding the iron alloy, and examples of the iron alloy include Fe—Si-based alloys, Fe—Si—Cr-based alloys, Fe—Si—Al-based alloys, Fe—Ni-based alloys, Fe—Co-based alloys, and Fe—Si—B—Nb—Cu-based alloys. The above-described alloys may further contain B, C, and the like as other secondary components. There is no particular limitation regarding the content of the secondary components, and the content may be, for example, about 0.1% by weight or more and 5.0% by weight or less (i.e., from about 0.1% by weight to 5.0% by weight) and preferably about 0.5% by weight or more and 3.0% by weight or less (i.e., from about 0.5% by weight to 3.0% by weight). The above-described metal material may be at least one type.

There is no particular limitation regarding the ferrite material constituting the ferrite particles, and examples of the ferrite material include ferrite materials containing Fe, Zn, Cu, and Ni as primary components.

According to an aspect, the magnetic powder has an average particle diameter of preferably about 0.5 μm or more and 20 μm or less (i.e., from about 0.5 μm to 20 μm), more preferably about 1.0 μm or more and 15 μm or less (i.e., from about 1.0 μm to 15 μm), and further preferably about 1.0 μm or more and 10 μm or less (i.e., from about 1.0 μm to 10 μm). Setting the average particle diameter of the magnetic powder to be 0.5 μm or more facilitates the handling of the magnetic powder. Meanwhile, setting the average particle diameter of the magnetic powder to be 20 μm or less enables the filling ratio of the magnetic powder to increase and enables the characteristics of the magnetic powder to be obtained more effectively. For example, in the case in which the magnetic powder is metal particles, the magnetic characteristics are improved.

In this regard, the average particle diameter is calculated on the basis of the equivalent circle diameters of the magnetic powder in a SEM (scanning electron microscope) image of a cross section of the element assembly. For example, the average particle diameter can be obtained by taking SEM images of a plurality of (for example, five) regions (for example, 130 μm×100 μm) in a cross section obtained by cutting the coil component 1, analyzing the resulting SEM images by using image analysis software (for example, Azokun (registered trademark) produced by Asahi Kasei Engineering Corporation) so as to determine the equivalent circle diameters of 500 or more metal particles, and calculating the average.

The surface of the magnetic powder may be covered with a coating film of an insulating material (hereafter also simply referred to as "insulating coating film"). Coverage of the surface of the magnetic powder with the insulating coating film enables the internal specific resistance of the element assembly to increase.

The surface of the magnetic powder may be covered with the insulating coating film to the extent that insulation performance between particles can be enhanced, and merely part of the surface of the magnetic powder may be covered with the insulating coating film. There is no particular limitation regarding the shape of the insulating coating film, and the shape may be a mesh-like shape or a layered shape.

According to a preferable aspect, a region of about 30% or more, preferably about 60% or more, more preferably about 80% or more, further preferably about 90% or more, and particularly preferably about 100% of the surface of the magnetic powder may be covered with the insulating coating film.

There is no particular limitation regarding the thickness of the insulating coating film, and the thickness may be preferably about 1 nm or more and 100 nm or less (i.e., from about 1 nm to 100 nm), more preferably about 3 nm or more and 50 nm or less (i.e., from about 3 nm to 50 nm), further preferably about 5 nm or more and 30 nm or less (i.e., from about 5 nm to 30 nm), and, for example, about 10 nm or more and 30 nm or less (i.e., from about 10 nm to 30 nm) or about 5 nm or more and 20 nm or less (i.e., from about 5 nm to 20 nm). Increasing the thickness of the insulating coating film enables the specific resistance of the element assembly to be enhanced. Meanwhile, decreasing the thickness of the insulating coating film enables the amount of the metal material in the element assembly to be increased, the magnetic characteristics of the element assembly to be improved, and the coil component to be readily reduced in size.

According to an aspect, the insulating coating film is formed of an insulating material containing Si. Examples of the insulating material containing Si include silicon-based compounds such as $SiO_x$ (x is 1.5 or more and 2.5 or less (i.e., from 1.5 to 2.5), and $SiO_2$ is a representative).

According to an aspect, the insulating coating film is an oxide film formed by oxidizing the surface of the magnetic powder.

There is no particular limitation regarding the coating method of the insulating coating film, and a coating method known to a person skilled in the art, for example, a sol-gel method, a mechanochemical method, a spray dry method, a fluidized-bed granulation method, an atomization method, or a barrel-sputtering method, may be used.

The magnetic permeability μ1 of the magnetic portion 10 is preferably about 20 or more and 40 or less (i.e., from about 20 to 40) and more preferably about 25 or more and 35 or less (i.e., from about 25 to 35).

Regarding the element assembly 2, the ratio μ2/μ1 of the magnetic permeability μ2 of the support substrate 6 to the magnetic permeability μ1 of the magnetic portion 10 is preferably about 0.7 or less, more preferably about 0.54 or less, further preferably about 0.30 or less, and further preferably about 0.20 or less. In addition, the ratio μ2/μ1 is preferably about 0.05 or more, more preferably about 0.08 or more, and further preferably about 0.15 or more. Setting the ratio μ2/μ1 to be within the above-described range improves the degree of flexibility in adjustment of the coupling coefficient between the first coil 7 and the second coil 8.

Regarding the element assembly 2, the coordinates (x, y) are present in a region surrounded by points A-B-C-D-E-F-G-H-I-J-A described below A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents the thickness of the support substrate 6 and y represents the ratio μ2/μ1. When (x, y) satisfy the above-described relationship, the coupling coefficient between the first coil 7 and the second coil 8 readily falls within the range of about −0.7 or more and −0.5 or less (i.e., from about −0.7 to −0.5).

According to a preferable aspect, the coordinates (x, y) are present in a region surrounded by points A'-B'-C'-D'-E'-F'-G'-H'-I'-J'-A' described below A' (40, 0.23), B' (50, 0.17), C' (60, 0.13), D' (70, 0.11), E (80, 0.08), F' (80, 0.14), G' (70, 0.18), H' (60, 0.22), f (50, 0.29), and J' (40, 0.39)

and when (x, y) satisfy the above-described relationship, the coupling coefficient between the first coil 7 and the second coil 8 readily falls within the range of about −0.65 or more and −0.55 or less (i.e., from about −0.65 to −0.55).

The first outer electrode 3*a*, the second outer electrode 3*b*, the third outer electrode 4*a*, and the fourth outer electrode 4*b* (hereafter also collectively referred to as "outer electrodes") are partly disposed on the respective end surfaces of the coil component 1 and the respective upper and lower surfaces extending from the end surfaces.

The outer electrodes are formed of a conductive material, preferably at least one metal material selected from a group consisting of Au, Ag, Pd, Ni, Sn, and Cu.

The outer electrodes may be formed by performing plating or applying a paste containing a conductive material and performing curing or baking or may be formed by combining these.

Each of the outer electrodes may be a single layer electrode or a multilayer electrode.

According to an aspect, the outer electrodes are multilayer electrodes. Preferably, each of the outer electrodes is composed of three layers of a Ag layer, a Ni layer, and a Sn layer.

The coil component 1 excluding the outer electrodes may be covered with a protective layer.

The material constituting the protective layer is preferably an insulating material. Examples of the insulating material include resin materials having high electrical insulation performance such as acrylic resins, epoxy resins, phenol resins, and polyimides, and the protective layer may be formed of at least two types of resin materials.

There is no particular limitation regarding the thickness of the protective layer, and the thickness is preferably about 3 μm or more and 20 μm or less (i.e., from about 3 μm to 20 μm), more preferably about 3 μm or more and 10 μm or less (i.e., from about 3 μm to 10 μm), and further preferably about 3 μm or more and 8 μm or less (i.e., from about 3 μm to 8 μm). Setting the thickness of the protective layer to be within the above-described range enables the insulation performance of the surface of the coil component 1 to be ensured while an increase in the size of the coil component 1 is suppressed.

Next, the method for manufacturing the coil component 1 according to the present embodiment will be described.

Figure 6A:
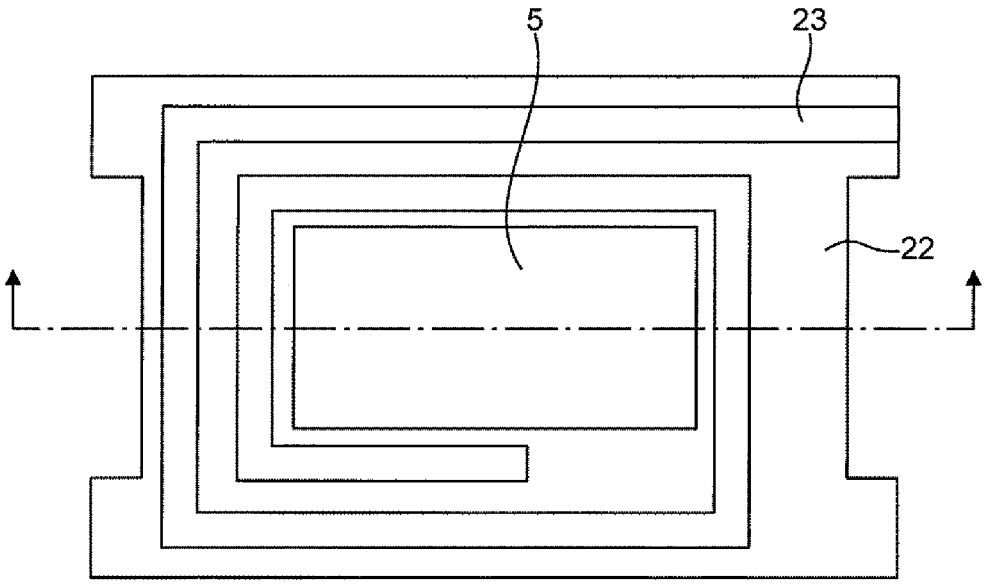
FIGS. 6A and 6B are a plan view and a sectional view, respectively, that illustrate a method for manufacturing the coil component.
Figure 6B:
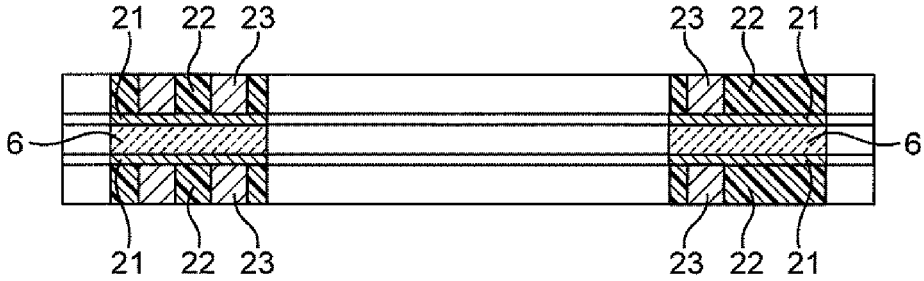

The support substrate 6 is prepared. A seed layer 21 to form a coil conductor is formed on each of the entire first principal surface and the entire second principal surface of the support substrate 6. The seed layer 21 may be formed by electroless copper plating, sputtering, or the like. Subsequently, a photosensitive resist layer is formed on the seed layer 21. The photosensitive resist layer may be formed by bonding a film resist or by applying a liquid resist. A resist pattern 22 to form a coil conductor is formed by subjecting the photosensitive resist layer to exposure through a mask and to development. A coil conductor 23 is formed in a space of the resist pattern 22 (FIGS. 6A and 6B). The coil conductor 23 may be formed by electroplating and preferably by electrolytic copper plating or the like.

Figure 7A:
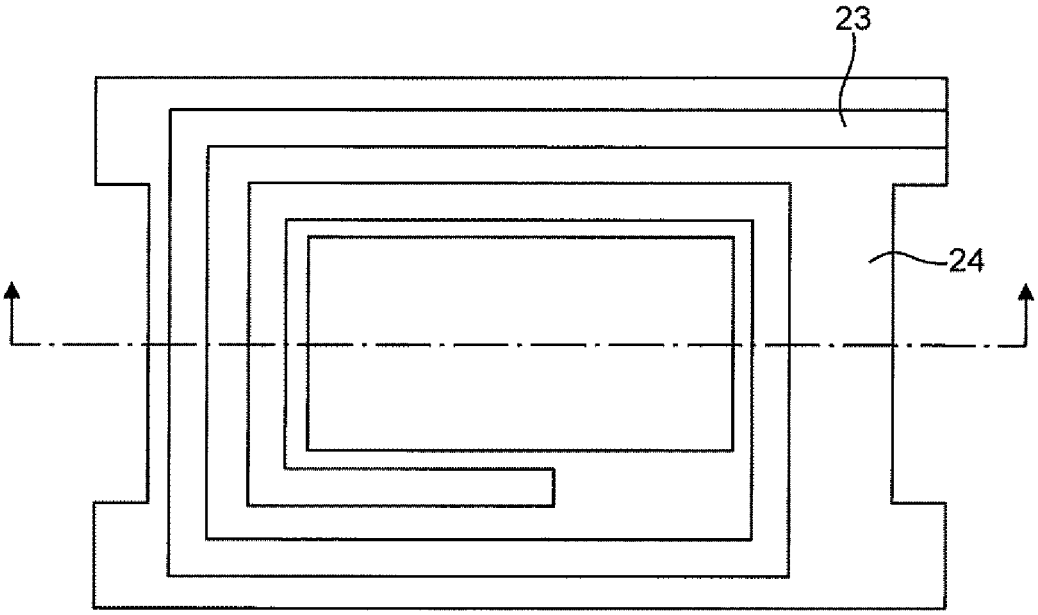
FIGS. 7A and 7B are a plan view and a sectional view, respectively, that illustrate a method for manufacturing the coil component.
Figure 7B:
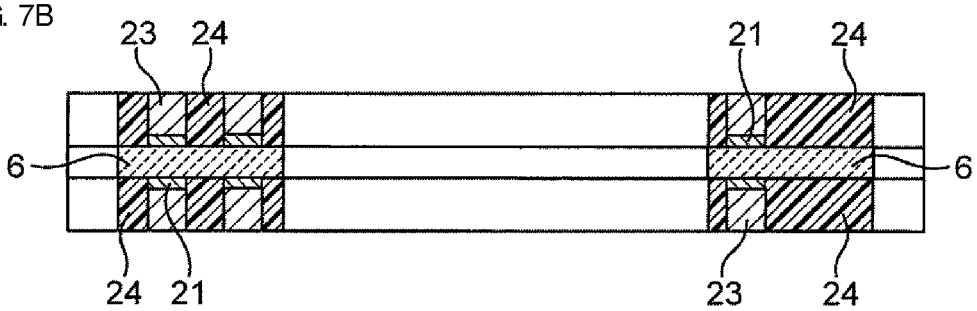

The resist pattern 22 is removed by using an organic solvent, an alkaline solvent, or the like. The seed layer 21 under the resist pattern 22 is removed by using a sulfuric-acid-based etchant, a phosphoric-acid-based etchant, or the like. Thereafter, an insulating portion 24 is formed by pouring a thermosetting resin into a space of the coil conductor 23 (portion in which the resist pattern 22 was located) and performing heat curing (FIGS. 7A and 7B). Preferable examples of the thermosetting resin include polyimide resins and epoxy resins.

Figure 8A:
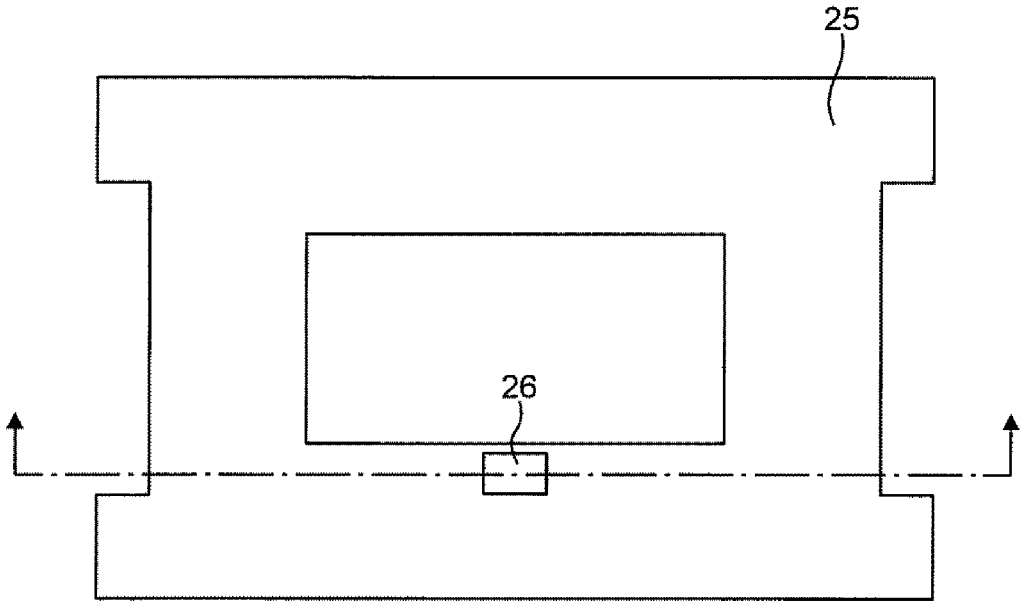
FIGS. 8A and 8B are a plan view and a sectional view, respectively, that illustrate a method for manufacturing the coil component.
Figure 8B:
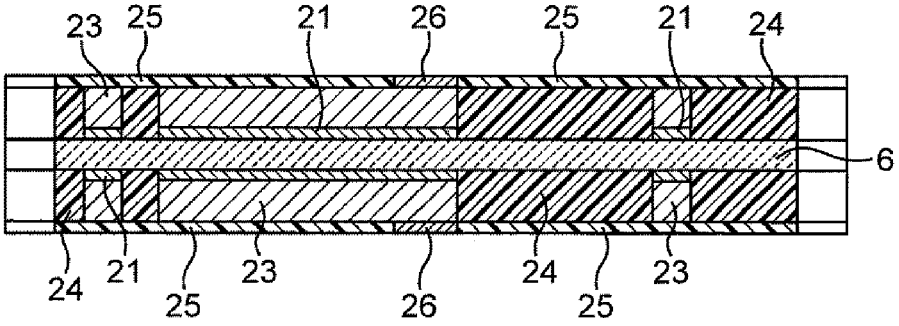

A photosensitive resist layer is formed and subjected to exposure through a mask and to development so as to form a resist pattern 25 having an opening at a location to be provided with a connection conductor. Subsequently, the connection conductor 26 is formed in a space of the resist pattern 25 (FIGS. 8A and 8B). The connection conductor 26 may be formed by electroplating and preferably electrolytic copper plating or the like.

Figure 9A:
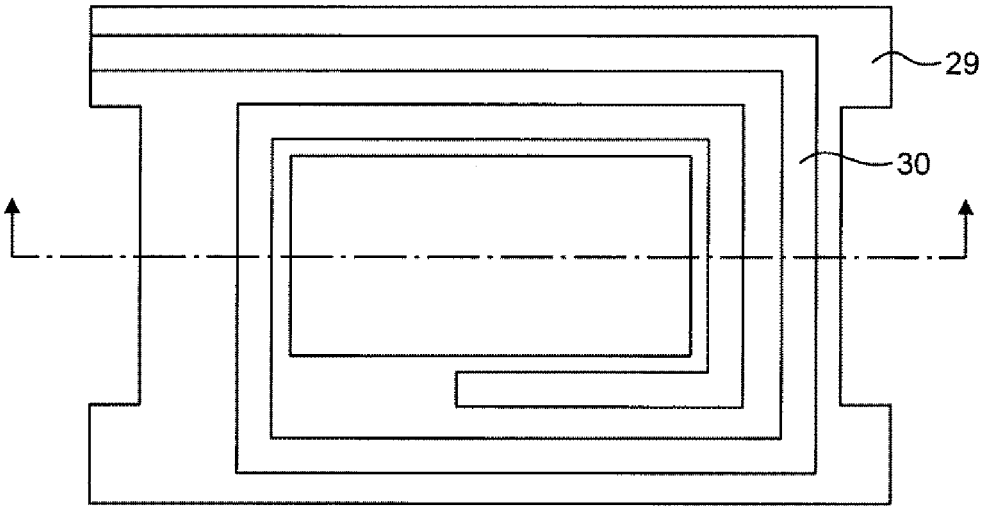
FIGS. 9A and 9B are a plan view and a sectional view, respectively, that illustrate a method for manufacturing the coil component.
Figure 9B:
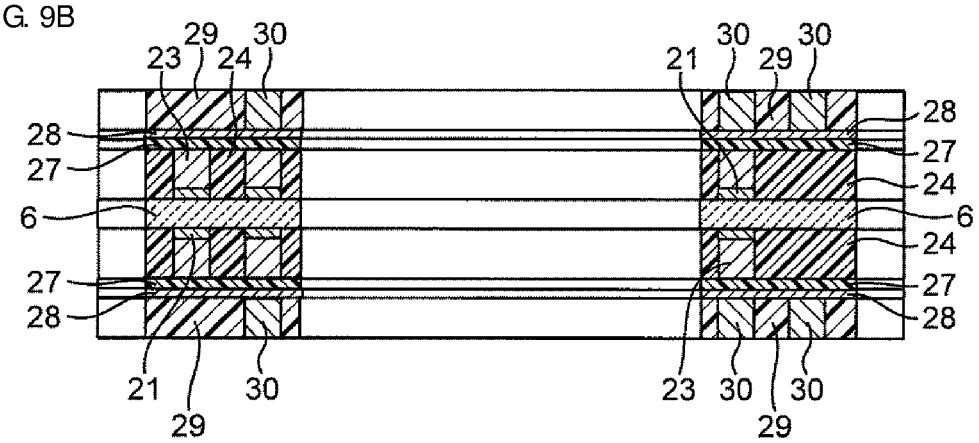

The resist pattern 25 is removed by using an organic solvent, an alkaline solvent, or the like. Thereafter, an insulating portion 27 is formed by pouring a thermosetting resin into the portion in which the resist pattern 25 was located and performing heat curing. A seed layer 28 to form a coil conductor is formed on the entire principal surface by electroless copper plating, sputtering, or the like. Subsequently, a photosensitive resist layer is formed on the entire seed layer 28 and is subjected to exposure through a mask and to development so as to form a resist pattern 29 to form a coil conductor. A coil conductor 30 is formed in a space of the resist pattern 29 by electrolytic copper plating or the like (FIGS. 9A and 9B).

Figure 10A:
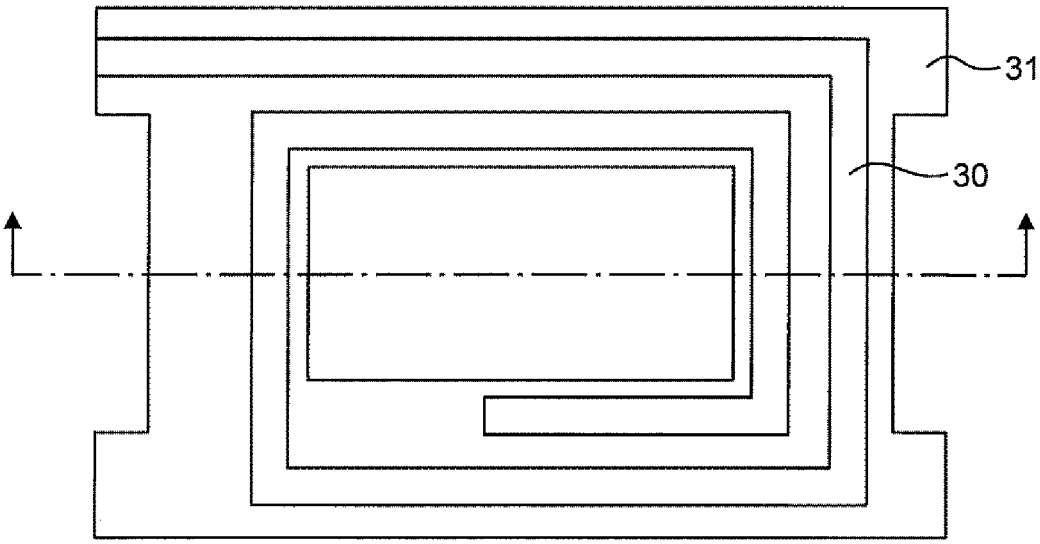
FIGS. 10A and 10B are a plan view and a sectional view, respectively, that illustrate a method for manufacturing the coil component.
Figure 10B:
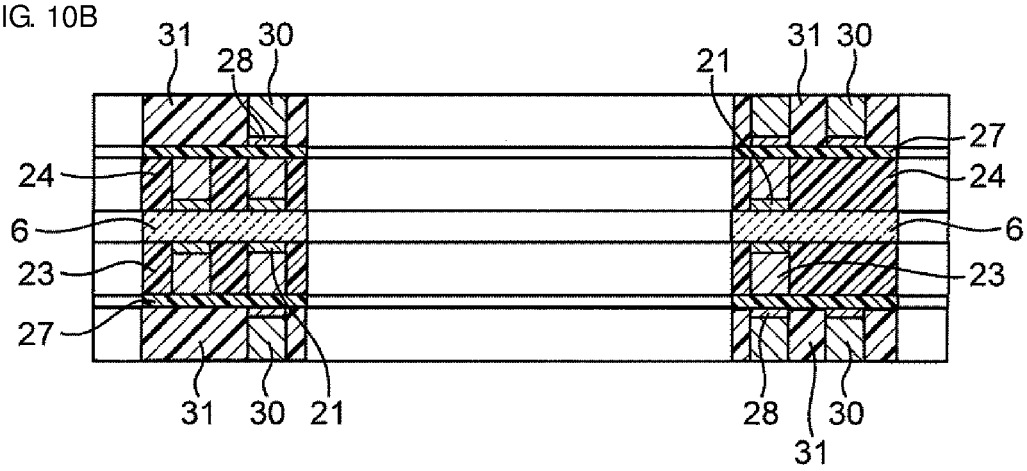

The resist pattern 29 is removed by using an organic solvent, an alkaline solvent, or the like. The seed layer 28 under the resist pattern 29 is removed by using a sulfuric-acid-based etchant, a phosphoric-acid-based-etchant, or the like. Thereafter, an insulating portion 31 is formed by pouring a thermosetting resin into a space of the coil conductor 30 (portion in which the resist pattern 29 was located) and performing heat curing (FIGS. 10A and 10B).

Figure 11A:
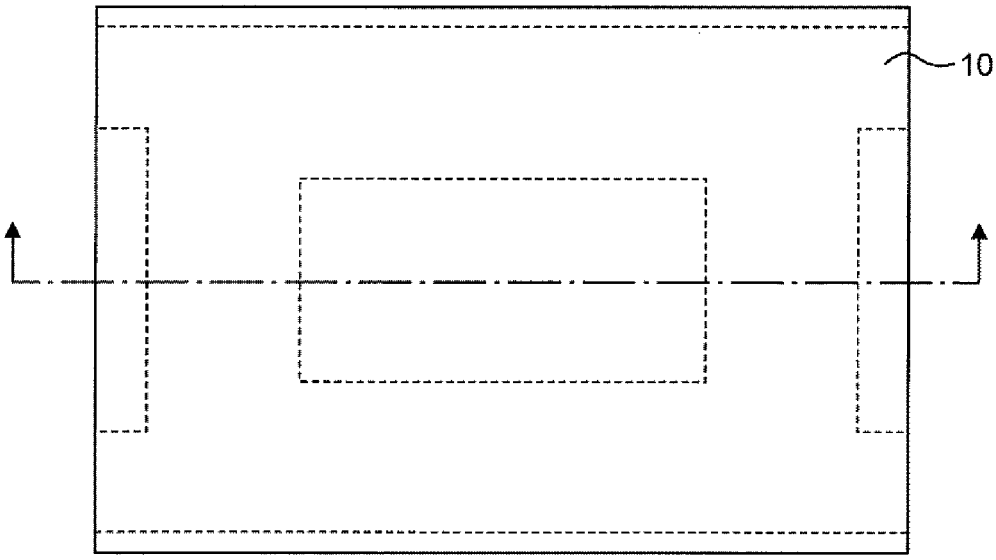
FIGS. 11A and 11B are a plan view and a sectional view, respectively, that illustrate a method for manufacturing the coil component.
Figure 11B:
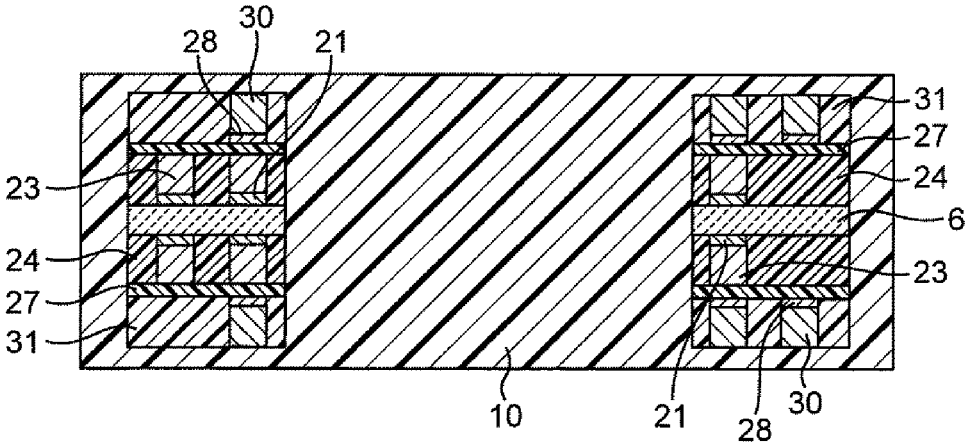
Figure 12:
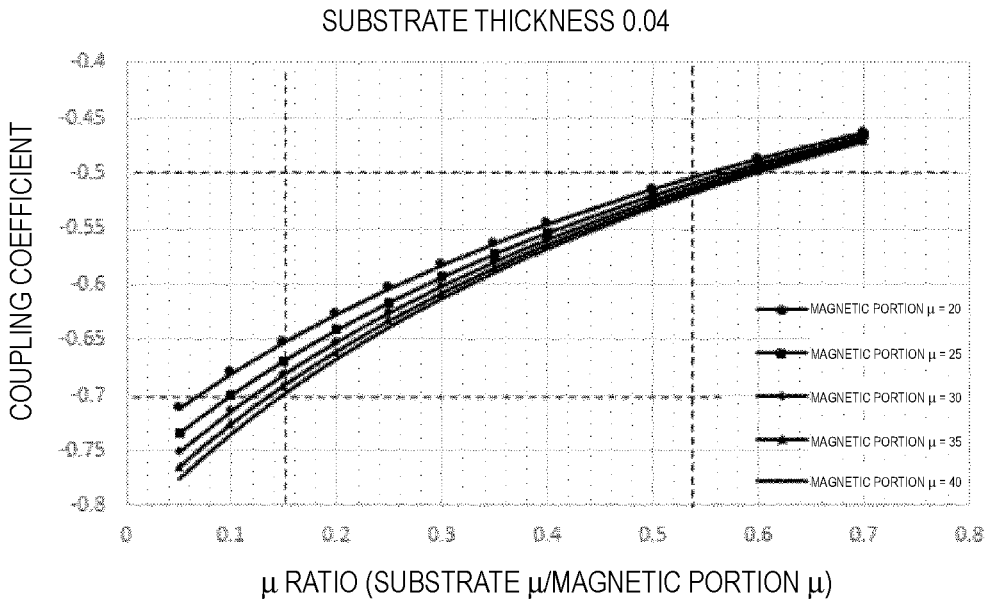
FIG. 12 is a graph showing the result of simulation of the relationship between the coupling coefficient and the μ2/μ1 when the substrate thickness is 40 μm.
Figure 13:
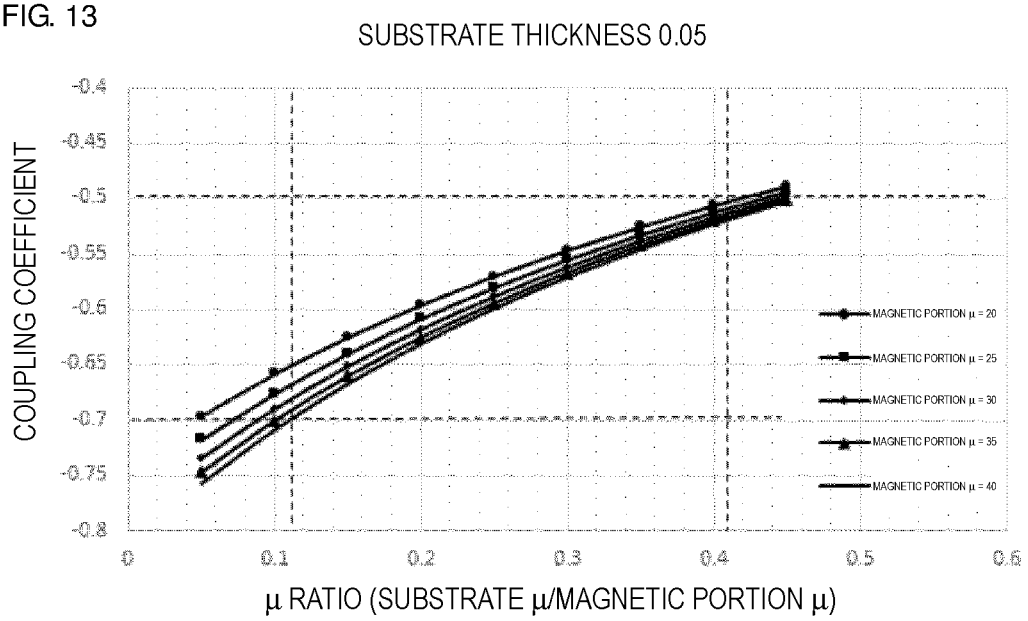
FIG. 13 is a graph showing the result of simulation of the relationship between the coupling coefficient and the μ2/μ1 when the substrate thickness is 50 μm.
Figure 14:
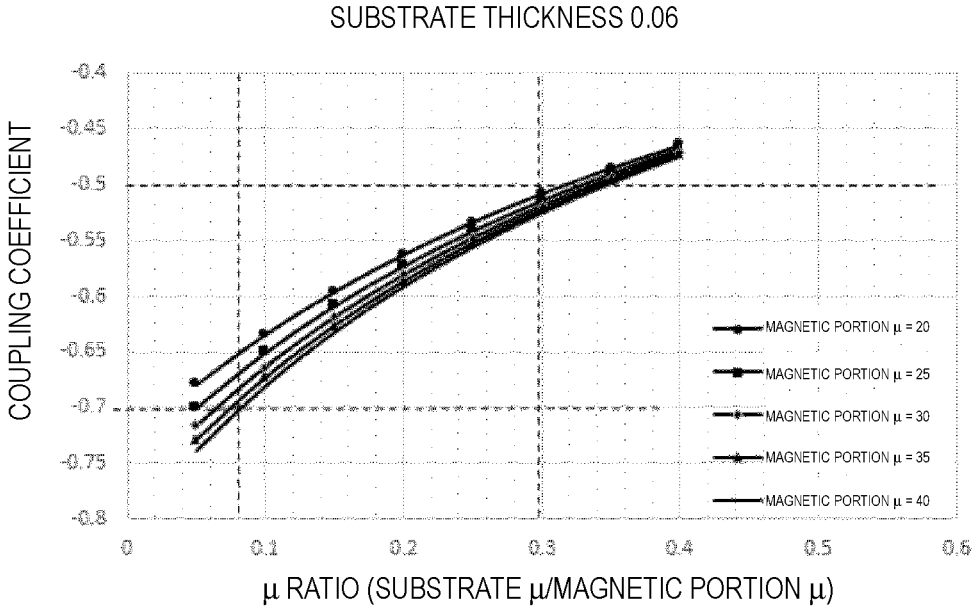
FIG. 14 is a graph showing the result of simulation of the relationship between the coupling coefficient and the μ2/μ1 when the substrate thickness is 60 μm.
Figure 15:
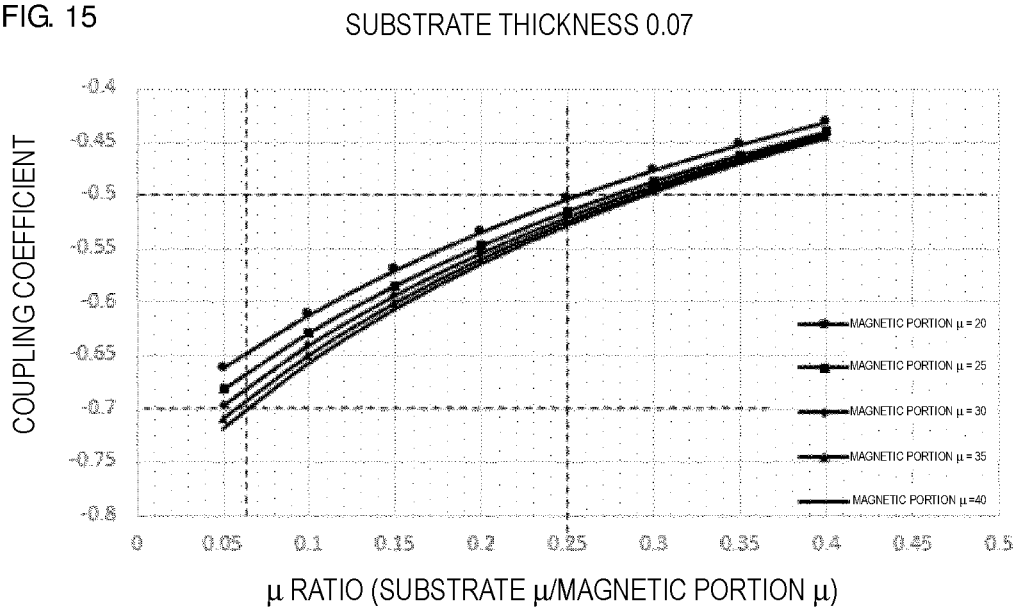
FIG. 15 is a graph showing the result of simulation of the relationship between the coupling coefficient and the μ2/μ1 when the substrate thickness is 70 μm.
Figure 16:
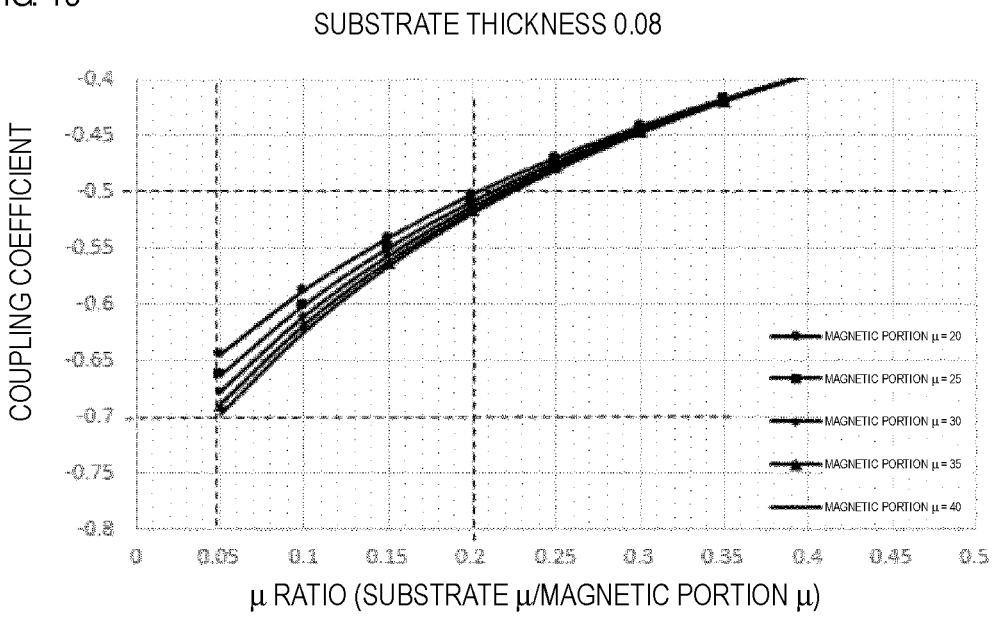
FIG. 16 is a graph showing the result of simulation of the relationship between the coupling coefficient and the μ2/μ1 when the substrate thickness is 80 μm.

A magnetic portion 10 is formed by coating all surfaces (including cavities) excluding the end surfaces with a magnetic paste containing a magnetic powder and a resin material and by performing heat curing (FIGS. 11A and 11B).

Underlying electrodes are formed by coating four portions of the end surfaces, to which the start edges and end edges of the coils extend, with a conductive paste, for example, a paste composed of a Ag powder and an epoxy resin, and by performing heat curing. First to fourth outer electrodes are formed by forming a Ni coating film and a Sn coating film successively on the underlying electrodes by electroplating so as to obtain the coil component 1 according to the present disclosure.

In this manner, the coil component 1 shown in FIG. 1 to FIG. 5 may be produced.

Up to this point, one embodiment according to the present disclosure has been described, but the present disclosure is not limited to the embodiment and can be variously modified.

Examples

Regarding the coil component 1 (L=2.0 mm, W=1.6 mm, and T=0.65 mm) shown in FIG. 1 to FIG. 5, the thickness of the support substrate was set to be 40 μm, 50 μm, 60 μm, 70 μm, or 80 μm, the magnetic permeability μ1 of the magnetic portion was set to be 20, 25, 30, 35, or 40, and the relationship between the ratio (μ2/μ1) of the magnetic permeability μ2 of the support substrate to the magnetic permeability μ1 of the magnetic portion and the coupling coefficient between the first coil 7 and the second coil 8 was simulated. The results are shown in FIG. 12 to FIG. 16.

From the simulation results, it was ascertained that the coupling coefficient fell within about −0.7 or more and −0.5 or less (i.e., from about −0.7 to −0.5) in the case in which (x, y) were present in a region surrounded by points A-B-C-D-E-F-G-H-I-J-A described below, A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents the thickness of the support substrate and y represents the ratio μ2/μ1.

The coil component according to the present disclosure is useful in applications for inductors and the like.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

an element assembly that includes a support substrate having a cavity, a first coil, disposed on a first principal surface of the support substrate, and having a first core portion, a second coil, disposed on a second principal surface of the support substrate, and having a second core portion, and a magnetic portion; and a first outer electrode and a second outer electrode electrically coupled to the first coil, and a third outer electrode and a fourth outer electrode electrically coupled to the second coil, each of the outer electrodes being disposed on a surface of the element assembly, wherein the cavity of the support substrate, the first core portion of the first coil, and the second core portion of the second coil overlap at least one another in plan view when viewed in the direction perpendicular to the principal surface of the support substrate, the magnetic portion is disposed in at least the cavity of the support substrate, the core portion of the first coil, and the core portion of the second coil, and the support substrate is formed of sintered ferrite.

2. The coil component according to claim 1, wherein a thickness of the support substrate is from 40 μm to 80 μm.

3. The coil component according to claim 1, wherein a magnetic permeability μ1 of the magnetic portion is from 20 to 40.

4. The coil component according to claim 1, wherein a ratio of a magnetic permeability μ2 of the support substrate to a magnetic permeability μ1 of the magnetic portion is 0.7 or less.

5. The coil component according to claim 1, wherein (x, y) are present in a region surrounded by A-B-C-D-E-F-G-H-I-J-A described below A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents a thickness of the support substrate and y represents a ratio of a magnetic permeability μ2 of the support substrate to a magnetic permeability μ1 of the magnetic portion.

6. The coil component according to claim 2, wherein a magnetic permeability μ1 of the magnetic portion is from 20 to 40.

7. The coil component according to claim 2, wherein a ratio of a magnetic permeability μ2 of the support substrate to a magnetic permeability μ1 of the magnetic portion is 0.7 or less.

8. The coil component according to claim 3, wherein a ratio of a magnetic permeability μ2 of the support substrate to the magnetic permeability μ1 of the magnetic portion is 0.7 or less.

9. The coil component according to claim 6, wherein a ratio of a magnetic permeability μ2 of the support substrate to the magnetic permeability μ1 of the magnetic portion is 0.7 or less.

10. The coil component according to claim 2, wherein (x, y) are present in a region surrounded by A-B-C-D-E-F-G-H-I-J-A described below A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents the thickness of the support substrate and y represents a ratio of a magnetic permeability μ2 of the support substrate to a magnetic permeability μ1 of the magnetic portion.

11. The coil component according to claim 3, wherein (x, y) are present in a region surrounded by A-B-C-D-E-F-G-H-I-J-A described below A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents a thickness of the support substrate and y represents a ratio of a magnetic permeability μ2 of the support substrate to the magnetic permeability μ1 of the magnetic portion.

12. The coil component according to claim 4, wherein (x, y) are present in a region surrounded by A-B-C-D-E-F-G-H-I-J-A described below A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents a thickness of the support substrate and y represents a ratio of the magnetic permeability μ2 of the support substrate to the magnetic permeability μ1 of the magnetic portion.

13. The coil component according to claim 6, wherein (x, y) are present in a region surrounded by A-B-C-D-E-F-G-H-I-J-A described below A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents the thickness of the support substrate and y represents a ratio of a magnetic permeability μ2 of the support substrate to the magnetic permeability μ1 of the magnetic portion.

14. The coil component according to claim 7, wherein (x, y) are present in a region surrounded by A-B-C-D-E-F-G-H-I-J-A described below A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents the thickness of the support substrate and y represents a ratio of the magnetic permeability μ2 of the support substrate to the magnetic permeability μ1 of the magnetic portion.

15. The coil component according to claim 8, wherein (x, y) are present in a region surrounded by A-B-C-D-E-F-G-H-I-J-A described below A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents a thickness of the support substrate and y represents a ratio of the magnetic permeability μ2 of the support substrate to the magnetic permeability μ1 of the magnetic portion.

16. The coil component according to claim 9, wherein (x, y) are present in a region surrounded by A-B-C-D-E-F-G-H-I-J-A described below A (40, 0.15), B (50, 0.11), C (60, 0.08), D (70, 0.06), E (80, 0.05), F (80, 0.20), G (70, 0.25), H (60, 0.30), I (50, 0.41), and J (40, 0.54)

where x (μm) represents the thickness of the support substrate and y represents a ratio of the magnetic permeability μ2 of the support substrate to the magnetic permeability μ1 of the magnetic portion.

* * * * *